United States Patent [19]

Liebig

[11] 4,411,324

[45] Oct. 25, 1983

[54] BORE UNDERCUTTING TOOL

[76] Inventor: Heinrich Liebig, Wormser Strasse 23, 6102 Pfungstadt, BRD, Fed. Rep. of Germany

[21] Appl. No.: 278,558

[22] Filed: Jun. 29, 1981

[30] Foreign Application Priority Data

Jun. 30, 1980 [DE] Fed. Rep. of Germany ..... 3024656

[51] Int. Cl.[3] ..... E21B 10/32

[52] U.S. Cl. ..... 175/289; 82/1.5; 408/159; 166/55.7

[58] Field of Search ..... 175/288–290; 408/159; 82/1.5, 1.4; 166/55.7

[56] References Cited

U.S. PATENT DOCUMENTS

| | | | |
|---|---|---|---|
| 165,787 | 7/1875 | Bullock | 175/286 X |
| 226,067 | 3/1880 | Hayden | 408/159 |
| 473,909 | 5/1982 | Bullock | 175/286 |
| 1,045,670 | 11/1912 | Buck et al. | 175/286 |
| 1,955,631 | 4/1934 | Harris | 175/289 |
| 2,202,986 | 6/1940 | Ellis | 166/55.7 |
| 2,203,011 | 6/1940 | Ellis et al. | 166/55.7 |

FOREIGN PATENT DOCUMENTS

| | | | |
|---|---|---|---|
| 2731901 | 2/1979 | Fed. Rep. of Germany | 175/289 |

*Primary Examiner*—Ernest R. Purser

[57] ABSTRACT

A bore undercutting tool which is composed of a barrel and a cutter feed driver which is inserted for longitudinal displacement but also for co-rotation into the barrel and projects from the rearward end thereof. In a slot provided in the forward end portion of the barrel there is fulcrumed a cutter in the form of a two-armed lever which can be rocked by a cutter feed cam provided on the forward end of the cutter feed driver, in proportion to the longitudinal displacement of the latter relative to the barrel, such that a cutting tool disposed on the one lever arm can either be retracted into the slot or rocked out of same. A spring biases the barrel and the cutter feed driver toward a position in which the cutting tool is withdrawn into the slot.

12 Claims, 5 Drawing Figures

BORE UNDERCUTTING TOOL

BACKGROUND

Figure 1:
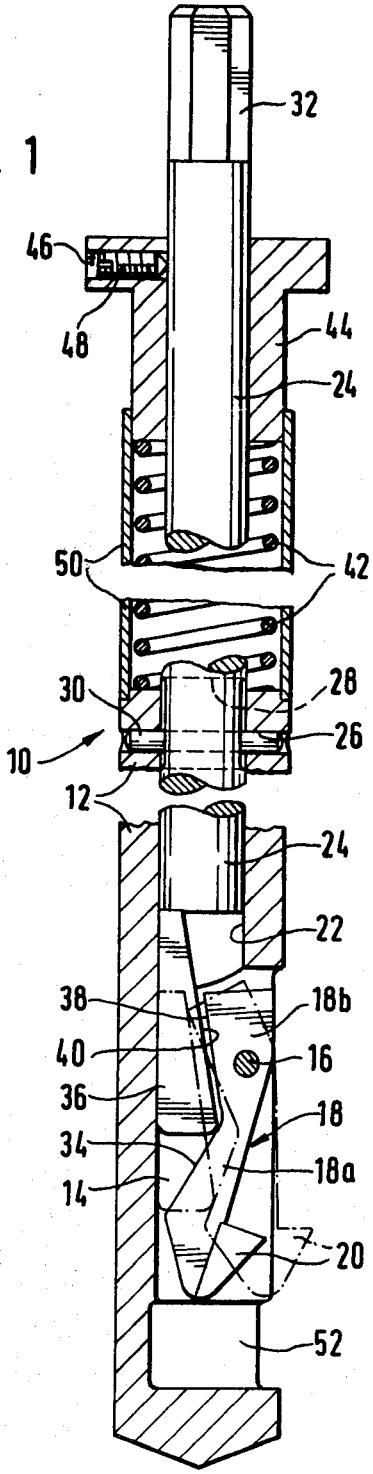

The invention relates to an undercutting tool for producing undercuts in pilot bores in masonry, concrete, rock and the like, having a rotary tool barrel which can be inserted into the bore that is to be undercut, at least one cutting tip being disposed in the bore-internal end portion of the barrel such that its cutting edge can be displaced gradually and radially outwardly into the wall of the pilot bore when the barrel is placed in the latter, the cutting tip being disposed on a cutter in the form of a two-armed lever which is fulcrumed in a longitudinal slot provided in the bore-internal end portion of the barrel and is capable of being rocked by the bore-internal end of a cutter feed driver which is mounted for longitudinal displacement by a certain amount in the barrel but held co-rotationally therewith, so that, by pushing the cutter feed driver into the barrel, the cutter can be shifted from a position in which the lever is retracted into the slot to a position in which the cutter projects from the barrel, a spring being provided in the undercutting tool, which biases the cutter toward the retracted position.

In this known bore undercutting tool (German Offenlegungsschrift No. 2,731,901, FIG. 2), which has been tested and found practical, the spring biasing the cutter toward the retracted position directly engages the lever arm of the cutter at its rearward end, i.e., the end pointing toward the orifice of the bore, being disposed under bias between the back of this lever arm and the opposite wall of the slot containing the cutter. Since the amount of the interstice available for the spring is, however, very limited, the biasing force exerted by the spring is also limited. After the known tool has been operated, the dust cut from the bore wall clogs the recess in the cutter and in some cases it may happen that the retraction of the cutter into the slot afterwards is prevented or the force of the spring is not sufficient to withdraw the cutter all the way into the slot, so that additional manipulations are necessary in order to remove the undercutter from the bore. It has furthermore been found that the time required for undercutting in high-strength concretes is relatively long, and this is to be attributed to the fact that the thrust exerted by the tool feed driver, which in the known tool is applied through a ramp on the end of the cutter feed driver to the lever arm on the bore orifice end of the cutter, engages the lever arm with a leverage which diminishes as the cutter is advanced into the material, i.e., the percentage of the thrust on the cutter feed driver which is transformed to the thrust of the cutter diminishes as the depth of the undercut increases.

Accordingly, it is the object of the invention to improve the cutting efficiency of the undercutting tool to such an extent that it will be possible to produce undercuts in bores in high-strength concretes within a relatively short time, and still avoid any impairment of the operation of the undercutter by the dust produced by the cutting action.

Setting out from an undercutting tool of the kind mentioned above, this object is achieved in accordance with the invention in that the back edge of the inner arm of the cutter, which bears the cutting tip is at an angle to the direction of movement of the cutter feed driver, and is engaged by a cutter feed cam formed on the inner end of the cutter feed driver, and this cam rocks the cutter out of the slot in the barrel with a leverage which becomes increasingly greater as the cutter feed driver is moved relatively to the barrel into the interior of the bore. Thus, by the shifting of the point at which the feed driver engages the back edge of the inner arm of the cutter an improvement of the transmission of force is achieved, resulting in an improvement of the cutting action as the cutting process progresses.

In a preferred further development of the invention, the back edge of the outer arm of the cutter is at an angle opposite that of the inner arm, and it is engaged by the cutter feed cam when the driver is drawn out of the bore interior relative to the barrel. The withdrawal of the cutter feed driver after the undercut has been completed then positively produces a retraction of the cutter into the slot in the barrel. There is consequently no longer any need to provide in the slot in the shaft a spring for the retraction of the cutter. Since the operation of the tool, however, is simplified, when the cutter is automatically retracted into the slot upon the completion of the undercut, the invention is further improved by providing on the portion of the cutter feed driver extending from the barrel a coil spring compressively biased against the barrel at one end and against the cutter feed driver at the other; this spring automatically draws the cutter feed driver back out of the barrel when the operator stops exerting pressure on it.

It is desirable for the coil spring to thrust at one end against the bore orifice end of the barrel, and at the other end against a collar provided on the cutter feed driver, and it may be desirable to enable the collar to be affixed at selectable axial positions on the cutter feed driver projecting from the barrel, since in this manner the bias of the coil spring will be variable.

At the same time it is desirable to dispose the coil spring within a sleeve attached to the end of the barrel, and for this sleeve to be engaged in a longitudinally displaceable manner by the end of the collar facing the bore. Thus the coil spring will be completely encapsulated within the sleeve.

The co-rotational and longitudinally displaceable coupling of the cutter feed driver with the tool barrel is accomplished in the simplest case by a pin provided in a transverse bore in the barrel and in an elongated hole in the driver.

Alternatively this coupling can also be created by providing the driver with a splineshaft section disposed corotationally but longitudinally displaceably in a hollow section of the barrel, provided with a complementary splined internal cross section.

In another embodiment of the invention, the cutter feed driver is in the form of a splineshaft-like section in its portion protruding from the barrel, which engages at its end facing the barrel in a counterbored section of the barrel which is provided with a complementary splined internal cross section, the splineshaft section being displaceable in the barrel section by the amount required for the rocking of the cutter.

In this embodiment, too, a resilient return of the cutter feed driver relative to the barrel can be devised for the purpose of simplifying the operation of the tool, by providing a compression spring within the counterbored section of the barrel such that at one end it thrusts against the forward end surface of the splineshaft section and against the bottom of the counterbored section of the barrel.

An improvement of the operation of the tool constructed in the manner of the invention is achieved by prolonging the slot that contains the cutter into the section of the barrel that is ahead of the cutter in the direction of insertion, and into a pocket for receiving the material (dust) cut by the cutter from the wall of the pilot bore. This prevents interference with the retraction of the cutter by the dust that accumulates in the slot.

This can be accomplished also by aspirating the dust from the pilot bore. In the embodiments in which there is a splineshaft coupling between the barrel and the cutter feed driver, the latter can be bored centrally through its entire length for this purpose, so that this bore will lead into the slot containing the cutter. An apparatus for the aspiration of the dust from the orifice of the bore must then be provided on the machine that drives the undercutting tool.

Figure 2:
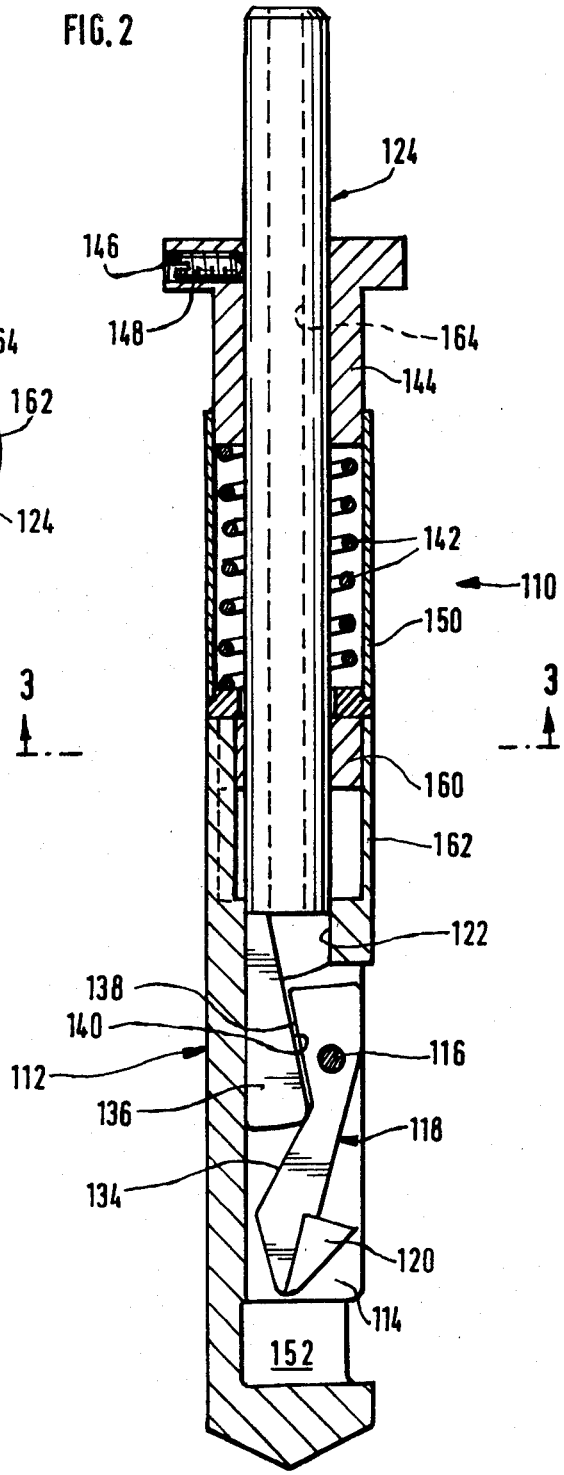
Figure 3:
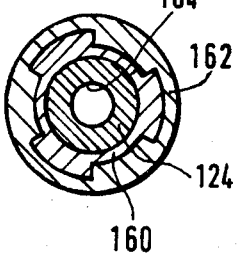
Figure 5:
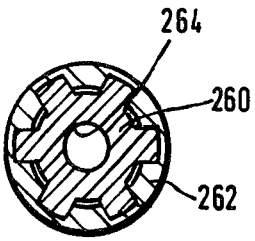
Figure 4:
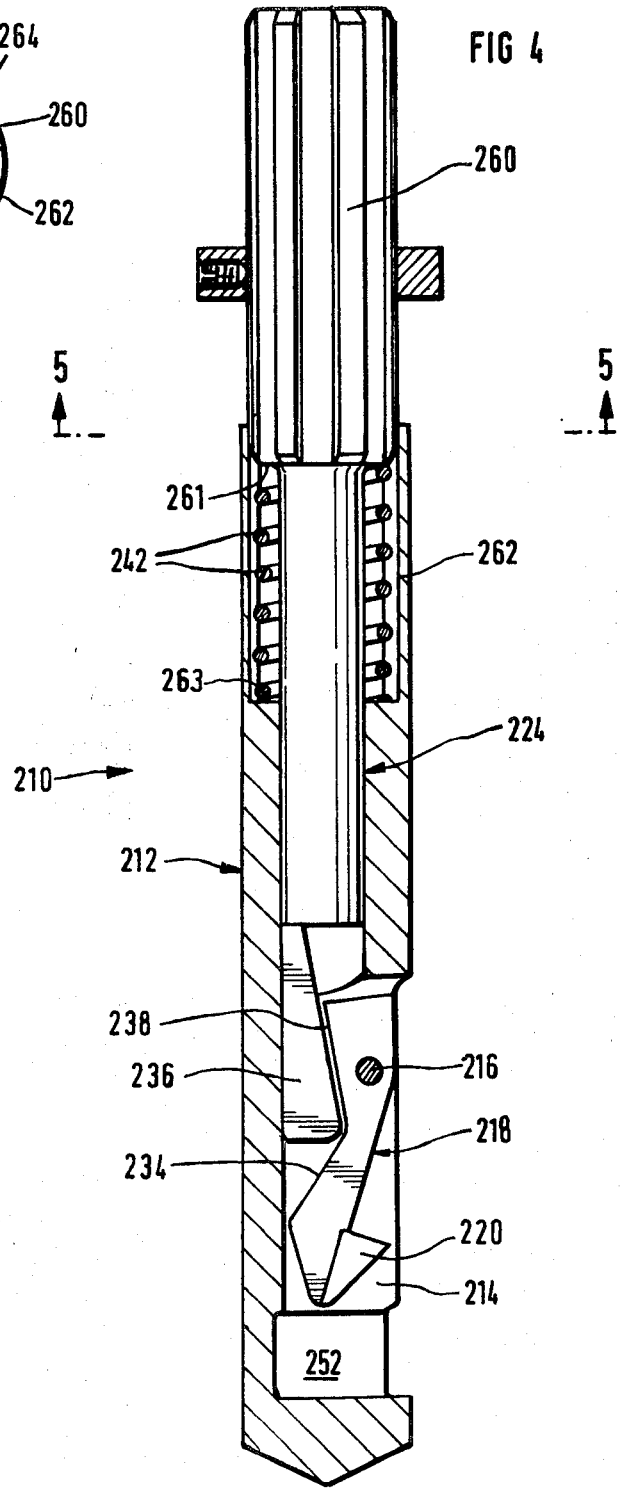

The invention is further explained in the description that follows of several embodiments, in conjunction with the appended drawing wherein, FIG. 1 is a longitudinal central section through a first embodiment of a bore undercutting tool constructed in the manner of the invention, FIG. 2 is a longitudinal central section through another embodiment of a bore undercutting tool in accordance with the invention, FIG. 3 is a cross section along line 3—3 of FIG. 2, FIG. 4 is a longitudinal central section through a third embodiment of the undercutting tool of the invention, and FIG. 5 is a cross-sectional view as seen in the direction of the arrows 5—5 in FIG. 4.

The drill of the invention, represented in FIG. 1 of the drawing and identified as a whole by the number 10, for making an undercut in a pilot bore previously produced in a conventional manner in rock, concrete, masonry or the like, is composed of a barrel 12 in whose lower portion, which is to be inserted into the pilot bore in the ground mass, there is provided a longitudinal slot 14. A cutter 18, in the form of a planar, two-arm lever is fitted within the slot 14, being fulcrumed on the pin 16. The actual cutting tip 20 is formed, for example, by a tungsten carbide plate hard soldered into a mating seat on the cutter 18 and has cutting edges ground to the shape of the undercut that is to be formed.

The barrel 12 contains a longitudinal central bore 22 running from its upper end to the slot 14, and a cutter feed driver 24 is inserted into this bore for longitudinal displacement but for co-rotation therewith. In the illustrated case, provision is made for such co-rotation by a pin 30 passing through a transverse bore 26 in the barrel 12 and an elongated hole 28 in the cutter feed driver 24. Instead of this, the longitudinal central bore and the cutter feed driver could also, at least in a portion, be of complementary polygonal cross section, e.g., square or hexagonal, or alternatively the rotation of parts 12 and 24 relative to one another can be prevented by a groove-and-spring coupling. To enable the boring tool 10 to be chucked in a motor-driven drill, the upper end of the cutter feed driver protruding from the barrel 12 is of hexagonal cross section.

The inside edge of the lower arm 18*a* of the cutter 18 is disposed at an angle to the direction of displacement of the tool feed shaft 24, its angle being so selected that, with respect to the state of the boring tool shown in the drawing, with the slot 14 opening to the right, it runs from the upper right to the lower left. The slightly rounded bottom end of a cutter feed cam 36 at the bottom end of the cutter feed driver 24 which extends past the back edge 38 of the upper lever arm 18*b* can be brought into engagement with edge 34 by pushing the cutter feed driver downwardly into the barrel. As the cutter feed driver moves downwardly, the cutter feed cam 36, whose back edge is braced against the back of the slot, forces the lever arm 18*a* toward the outside of the slot 14, causing the cutting tip 20 to project from the recess 14, until the cutter 18 assumes the position indicated in the drawing by broken lines, in which it projects beyond the circumference of the barrel 12. With respect to the fulcrum of the cutting tool holder 18, constituted by the pin 16, the leverage of the cutter feed cam 36 against edge 34 therefore increases as the cutter feed driver moves downwardly.

The back edge 38 of the upper lever arm 18*b* is angled oppositely to the angle of the edge 34. When the cutter feed driver 24 is drawn upwardly, therefore, the complementary surface 40 of the cutter feed cam 36 runs on the edge 38, forcing the cutter tool 18 to withdraw the cutting tip 20 back into the slot 14.

As described thus far, the boring tool 10 can perform its function, but it is made easier to use in practice by providing a coil spring 42 around the cutter feed driver 24 within the barrel 12, with its bottom end thrusting against the upper end of the barrel 12, while its upper end is biased against the bottom face of a collar 44 placed around the cutter feed driver 24 and affixed thereto. By means of a set screw 48 threaded in a radial bore 46 in the collar 44, the collar can be fastened at preselected axial positions on the cutter feed driver 24. The bias of the coil spring 42 is therefore variable to a certain extent.

The coil spring 42 is encased by a sleeve 50 whose lower end is attached to the upper end of the barrel 12 and whose upper end is fitted slidingly around the collar 44.

A pocket 52 communicating with the slot 40 serves to accommodate the chips and dust removed from the walls of the pilot bore by the cutting tip 20, thereby preventing the cutter 18 from becoming jammed in the projecting position by the accumulation of debris in the slot, and even if such debris does collect in the slot, it will be knocked down into the pocket 52 when the cutter feed driver is retracted.

The bore undercutting tool 110 illustrated in FIGS. 2 and 3 differs from the undercutting tool 10 described above only in the manner in which the cutter feed driver and barrel are coupled to one another for co-rotational longitudinal displacement, so that it will suffice to describe only this coupling, and the above description can be referred to concerning the general construction of the boring tool 110.

The parts of undercutting tool 110 which are the same as those of undercutting tool 10 are provided with the same reference numbers preceded by a 1.

The cutter feed driver 124 of undercutting tool 110 bears a splineshaft part 160 press-fitted or otherwise affixed to it, which engages a socket 162 of complementary splined construction at the upper end of the barrel 112, the length of the spline socket 162 being such in relation to the splineshaft part 160 that the latter is able to slide up and down within it against the action of spring 142 over the distance necessary for the operation of the cutter 118.

The cutter feed driver 124 is in this case provided with a longitudinal central bore 164 which makes it possible for the dust collecting in the slot 114 containing the cutter 118 to be sucked out continuously during the operation of the undercutting tool 110 if the machine which drives the tool is provided with a vacuum apparatus.

Again in the case of the undercutting tool 210 shown in FIGS. 4 and 5, the co-rotational longitudinal coupling between the cutter feed driver 224 and the barrel 212 is in the form of a spline coupling. For this purpose, all of the upper end of the driver 224 outside of the barrel 212 is in the form of a multiple spline shaft 260 whose lower end is engaged in a complementary internally grooved section 262 of the upper end of the barrel, thereby providing a form-locking coupling between the splined section 260 and the grooved section 262. The grooved barrel section 262 again is sufficiently long to enable the splined section 260 of the driver to be driven downwardly into section 262 by the amount necessary for the cutter feed. The compression spring 242 aiding the withdrawal of the cutter thrusts at the upper end against the bottom face 261 of the splined section 260 of the driver and at its bottom end against the bottom 263 of the grooved section 262 on the barrel 212. In this embodiment, too, the cutter feed driver 224 can be provided with a longitudinal central bore 264 (FIG. 5) for the aspiration of dust during the cutting process.

I claim:

1. An undercutting tool for producing an undercut in a pilot bore of relatively small diameter in masonry, concrete, rock and the like; said tool having a tool shaft adapted to be inserted into the pilot bore and adapted to be driven in rotation, a single cutting tool having a cutting edge and so disposed in one end section of the shaft to be inserted into the bore that the cutting edge, after insertion of the tool shaft into the pilot bore, can be displaced gradually radially outwardly into the wall of the pilot bore, said cutting tool being disposed on a cutting tool holder in the form of a two-armed lever pivotingly mounted in a longitudinally disposed, slot-like recess which is open on one side only to the circumferential surface of said end section of the tool shaft, said cutting tool holder being adapted to be pivoted from a retracted position wherein said cutting tool is retracted into the slot-like recess to a protruding position wherein said cutting tool protrudes from the tool shaft, a cutter feed shaft mounted so as to be longitudinally displaceable by a certain amount and co-rotationally in the tool shaft, said feed shaft having an outer end portion extending from the bore-outer end of the tool shaft, and a bore-internal end portion for engagement with said cutting tool holder, said cutting tool holder in the form of a two-armed lever having a backside opposite the cutting tool and a bore-internal first lever arm, a thrust surface on said first lever arm and running at an angle to the direction of displacement of the cutter feed shaft, a cutter feed cam formed on the bore-internal end of the cutter feed shaft which cam is supported on the closed side opposite said one open side of said slot-like recess and adapted to engage said surface and, which, upon the displacement of the cutter feed shaft relative to the tool shaft into the bore interior, rocks the first lever arm of the cutting tool holder out of the recess of the tool shaft with an increasingly larger lever arm, said cutting tool holder having a second lever arm the backside of which has a thrust surface running at a slant opposite that of said first lever arm, which is engaged by the cutter feed cam upon a displacement of the cutter feed shaft relative to the tool shaft out of the bore interior.

2. An undercutting tool according to claim 1, wherein said cutter feed shaft bears in the outer end portion a biased coil spring thrusting against the tool shaft on one end and against the cutter feed shaft on the other.

3. An undercutting tool according to claim 1, wherein said cutter feed shaft bears in the outer end portion a biased coil spring thrusting against the tool shaft on one end and against the cutter feed shaft on the other.

4. An undercutting tool according to claim 2 or 3, wherein said cutter feed shaft has a collar and wherein said coil spring thrusts against said collar.

5. An undercutting tool according to claim 4, wherein said collar is movable so as to be fastenable at selectable axial positions on the cutter feed shaft protruding from the tool shaft.

6. An undercutting tool according to claim 4, including a sleeve surrounding said coil spring, said sleeve being attached to one end of the tool shaft, and the front end of said collar pointing toward the bore engaging said sleeve in a longitudinally displaceable manner.

7. An undercutting tool according to any one of claims 1, 2 or 3, comprising a pin coupling said cutter feed shaft with the tool shaft co-rotationally but longitudinally displaceably, said pin being provided in a transverse bore in said tool shaft and passing through a longitudinal slot in said cutter feed shaft.

8. An undercutting tool according to any one of claims 1, 2 or 3, comprising a spline body on said cutter feed shaft and disposed co-rotationally with but longitudinally displaceably within a tool shaft section of sleeve-like construction having an internal spline profile complementary to the spline body.

9. An undercutting tool according to claim 1, wherein said outer end portion of said cutter feed shaft is constructed as a splineshaft section which, at its front end facing the tool shaft is partially engaged in a sleeve-like section of the tool shaft, which is provided with an internal splined profile complementary to the spline profile of the splined shaft section, said sleeve-like section being of such length that the splineshaft section is displaceable into the sleeve-like section to the extent necessary for the rocking of the cutting tool holder.

10. An undercutting tool according to claim 9, comprising a compression spring disposed within said sleeve-like section, said compression spring thrusting against a front end surface of the splineshaft section at one end and against the bottom of the sleeve-like section of the tool shaft at the other.

11. An undercutting tool according to any one of claims 1, 2 or 3, wherein said slot-like recess for the accommodation of the cutting tool holder extends into a section of the tool shaft in front of the cutting tool holder when looking in the driving direction, and to a receiving pocket for the material cut from the wall of the pilot bore by the cutting tool.

12. An undercutting tool according to any one of claims 1, 2 or 3, wherein said cutter feed shaft is pierced by a longitudinal bore which at the cutting tool end leads into the slot-like recess in the tool shaft, which receives the cutting tool holder.

* * * * *